United States Patent [19]

Fleck et al.

[11] Patent Number: 4,574,852

[45] Date of Patent: Mar. 11, 1986

[54] FEEDPIPE FOR A REFILLING CONTAINER

[75] Inventors: Adolf Fleck, Unterhaching; Alfons Kastl, Munich; Rudolf Loistl; Klaus Lehnert, both of Unterhaching; Ernst Widemann, Dachau, all of Fed. Rep. of Germany

[73] Assignee: AGFA-Gevaert AG, Leverkusen, Fed. Rep. of Germany

[21] Appl. No.: 614,729

[22] Filed: May 25, 1984

[30] Foreign Application Priority Data

Jun. 10, 1983 [DE] Fed. Rep. of Germany ..... 3321047

[51] Int. Cl.[4] ..... B65B 3/04

[52] U.S. Cl. ..... 141/286; 141/18; 138/103; 210/436; 239/542; 239/547

[58] Field of Search ..... 141/2, 18–29, 141/285–310; 239/542, 547; 210/188, 436; 138/41, 103

[56] References Cited

U.S. PATENT DOCUMENTS 3,139,123 6/1964 Lisciani ..... 141/309

FOREIGN PATENT DOCUMENTS 1086577 8/1960 Fed. Rep. of Germany .

*Primary Examiner*—Houston S. Bell, Jr.
*Attorney, Agent, or Firm*—Michael J. Striker

[57] ABSTRACT

In a feedpipe of a container for refilling a photographic developing tank with a developer radial discharge holes are provided in the region of a valve mounted at the lower end of the feedpipe extended outwardly of the container. The developer liquid is discharged into the valve and then into the tank through these radial holes. To prevent overflowing of the liquid through these holes meshed elements are inserted into the radial holes.

5 Claims, 2 Drawing Figures

FEEDPIPE FOR A REFILLING CONTAINER

BACKGROUND OF THE INVENTION

The present invention relates to a feedpipe for a refilling container, preferably for refilling a wet-developing apparatus for a film base with developer and regenerate liquids.

Refilling bottles or cans filled with a developer or regenerate liquid normally have a feedpipe extended through the bottle and opening into a valve connection element having an outlet opening. The feedpipe is also provided in the region of the valve connection element with a number of radial holes through which liquid is discharged from the bottle into the apparatus for wet-developing.

The refilling container with the feedpipe of the type under consideration is discussed, for example in DE AS 1,086,577. For extracting a dosed amount of the liquid from the refilling container, and to ensure a uniform pressure compensation in the container an additional dosing container is placed in the refilling container. Liquid flows lengthwise through the respective openings into the dosing container and then through the discharge holes in the feedpipe. However, the additional dosing container is considerably expensive.

Refilling containers not provided with the aforementioned additional containers are also utilized in the industry. These containers have the disadvantage that the large amounts of liquid discharged through the holes in the feedpipe provided in the proximity of the valve cause overflow of the liquid into the developing tank. Furthermore, large streams of air due to under-pressure have frequently flowed into the feedpipe of the refilling container and instead of leaving the pipe via its front opening they have been discharged through the holes in the vicinity of the valve and flowed into the refilling container. These air streams having usually caused disturbance in the liquid contained in the refilling container and because of air mixed with the liquid an undesired oxidation and thus worsening of the quality of the refilling liquid.

SUMMARY OF THE INVENTION

It is an object of the present invention to provide an improved refilling container.

It is a further object of the invention to provide a refilling container in which flooding and spilling of the liquid over the developing tank, into which the liquid is to be filled, are avoided and wherein mixing of air entering the container from below with the liquid in the container will be also prevented.

It is still another object of the present invention to provide a container with which a uniform discharge of the liquid from the container and an inflow of air through the upper opening of the feedpipe would be ensured. Since the incoming air flows in the usual fashion through the upper surface of the liquid the possibility of oxidation would be avoided.

These and other objects of the invention are attained by a feedpipe for a refilling container, preferably for filling a wet-developing apparatus for a photographic film base with a developer or regenerate liquid contained in the container, the feedpipe comprising a pipe portion extended through the container and having an upper end and a lower end; a valve member at said lower end and positioned outside the container, said feedpipe being open at said upper end and having at said lower end and near said valve member a plurality of radial holes through which the liquid is discharged from the container; and meshed elements inserted into said radial holes for preventing air from flowing through the feedpipe into the liquid in the container.

The feedpipe may further include an additional meshed element arranged at said open upper end of the feedpipe.

In the event of a viscous liquid contained in the container the meshed elements in the radial holes may have a mesh greater than that in the additional meshed element.

The pipe portion and the meshed elements may be formed integral with each other.

The pipe portion and the meshed elements may be formed of synthetic plastic material.

DETAILED DESCRIPTION OF THE PREFERRED EMBODIMENT

Figure 1:
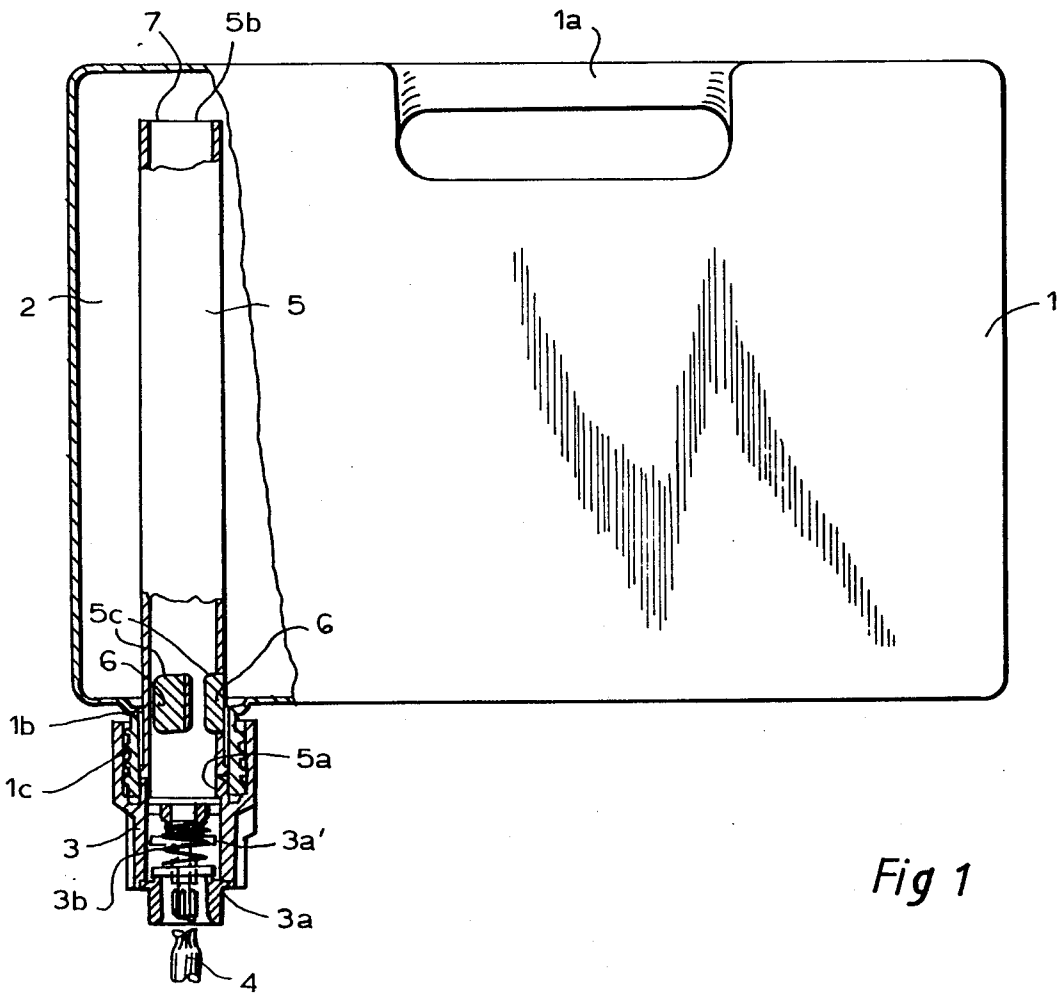
FIG. 1 is a side view, partially in section, of the refilling container with the feedpipe according to the invention.

Referring now to the drawings in detail, reference character 1 in FIG. 1 denotes a container for refilling a wet-developing apparatus with filling liquids, preferably with developer or regenerate liquids 2. This container may be a bottle or can which has a grip 1*a*. Container 1 is provided on the underside thereof with a discharge member 1*c* having an outer thread 1*c* and a discharge valve 3 which has an inner thread and is screwed on thread 1*c* of the discharge member with the aid of the commonly known sealing. Reference number 3*a* designates a valve disk, reference character 3*b* denotes a compression spring of valve 3 and reference number 4 identifies a plunger extended into the tank not shown herein. Container 1 is superimposed on that tank for refilling the latter with liquid 2.

Figure 2:
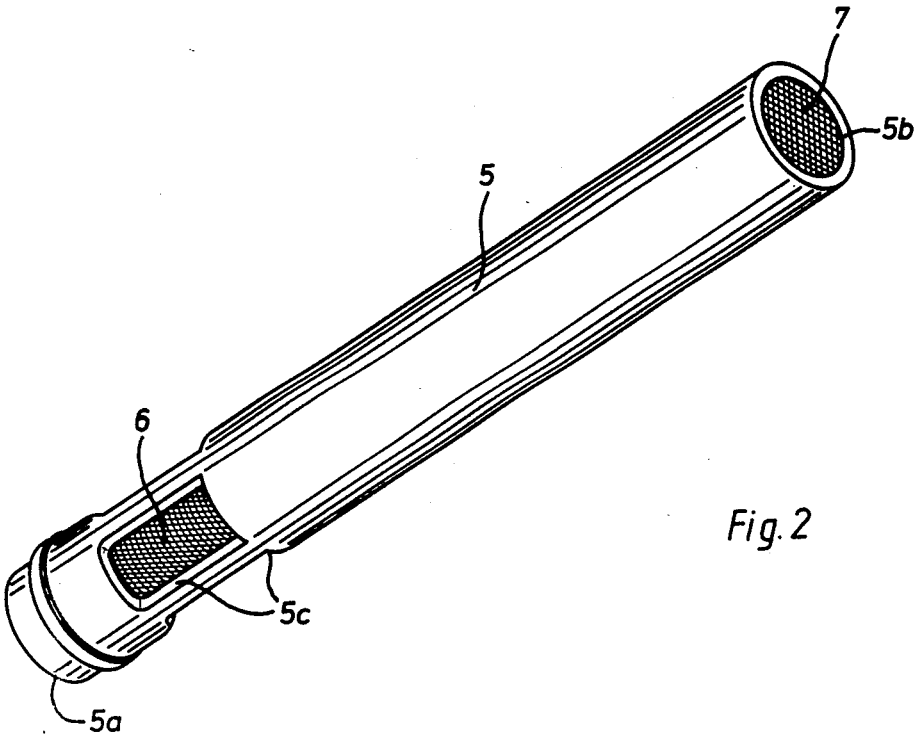
FIG. 2 is a perspective view of the feedpipe shown in FIG. 1.

When container or refiller 1 is placed on the tank plunger 4 pushes valve disk 3*a* into a position 3*a'* shown by a dotted line so that liquid 2 can flow in the downward direction into the non-illustrated tank. A feedpipe 5 extends upwardly from the valve disk. Feedpipe 5 has a lower opening 5*a* and an upper opening 5*b* and is also provided near and above valve 3 with a plurality of radial holes 5*c*. These holes as can be observed in FIG. 2 in particular are made in the lower region of the pipe.

During the positioning of the bottle or can 1 onto the non-illustrated tank plunger 4 via the valve disk 3 opens the liquid supply into the tank. Liquid 2 flows through the radial holes 5*c* in the feedpipe and is discharged through valve 3. Due to the underpressure existing in bottle 1 air is sucked through valve 3 into the feedpipe 5.

In order to avoid large overflow of the liquid through the radial holes 5*c* in the feedpipe 5 downwardly, which overflow would lead to running the liquid over the tank, and to prevent large air streams in the feedpipe 5, which could occur in this pipe with such a pressure that some of those air streams would leak out through radial holes 5*c* and flow back from below into bottle 1, meshed elements 6 are arranged in radial holes 5. Thereby bubbling of the liquid 2 and its oxidation will be also avoided. Meshed or strainer elements 6 act as brakes and uniformly distribute the liquid discharged from bottle 1 through feedpipe 5 and valve 3 and thereby prevent undesired liquid overflow from bottle 1. These meshed elements also prevent flowing of large air streams in the backward direction because these air streams can seek a quick way through those radial holes upwardly into the pipe. These large air streams, the movement of which through the liquid can cause undesired oxidation, must be first dispersed on meshed elements 6 before air can come out through radial holes 5*c*. Since air meets a small resistance airstreams rise in the feedpipe 5 unless they reach the upper opening 5*b* and then they normally flow out through the liquid surface. In order to avoid large air streams also at the upper end of the feedpipe 5 a meshed element 7 is arranged in the upper opening 5*b* of the pipe. This upper meshed element serves to disperse rising large air streams whereby air streams are inhibited and are permitted to leave the tube uniformly via the upper liquid surface.

Furthermore, due to the provision of meshed elements in radial holes 5*c* a dosed and uniform discharge of the liquid and a uniform rising of air in the feedpipe 5 are obtained in a very simple fashion. Due to the arrangement of meshed element 7 provided in the upper opening 5*b* and mounted flush with the upper surface of pipe 5 an additional uniform distribution of air entering the bottle 1 is provided and disturbance of the upper liquid surface is avoided. The meshed elements 6 and 7 can be formed as one piece with feedpipe 5 made from synthetic plastic so that for extraction of a dosed amount of liquid a constant lowering of the liquid upper surface, a stabilized air supply and a steady pressure compensation are not required, as in the case with known feedpipes having no meshed elements.

If necessary, for example in the case of viscous liquids, it is expedient to make the lower meshed elements 6 in radial holes 5*c* with the mesh greater than the mesh of upper element 7 in opening 5*b*.

It will be understood that each of the elements described above, or two or more together, may also find a useful application in other types of refilling containers for filling wet-developing apparatus with developer or regenerate liquids differing from the types described above.

While the invention has been illustrated and described as embodied in a feedpipe for a container for refilling a wet-developing apparatus with developer or regenerate liquids, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt if for various applications without omitting features that, from the standpoint of prior art, fairly constitute essential characteristics of the generic or specific aspects of the invention.

What is claimed as new and desired to be protected by Letters Patent is set forth in the appended claims:

1. A feedpipe for a refilling container, preferably for filling a wet-developing apparatus for a photographic film base with a developer or regenerate liquid contained in the container, the feedpipe comprising a pipe extended substantially within the container and having an upper end and a lower portion extending outwardly of the container; a valve member positioned on said lower portion outside the container, said pipe being open at said upper end and having at said lower portion a plurality of radial holes through which the liquid is discharged from the container; said radial holes being positioned near said valve member; and meshed elements inserted in said radial holes for preventing air from flowing through the feedpipe into the liquid in the container.

2. The feedpipe as defined in claim 1, further including an additional meshed element arranged at said open upper end of the pipe.

3. The feedpipe as defined in claim 2, wherein if a viscous liquid is contained in the container the meshed elements inserted in said radial holes have a mesh greater than that of said additional meshed element.

4. The feedpipe as defined in claim 2, wherein said pipe and said meshed elements are formed integral with each other.

5. The feedpipe as defined in claim 2, wherein said pipe and said meshed elements are formed of synthetic plastic material.

* * * * *